US005448455A

United States Patent [19]

Ryan

[11] Patent Number: 5,448,455

[45] Date of Patent: Sep. 5, 1995

[54] ANIMATED LIGHT SIGNAGE DEVICE AND PROCESS

[75] Inventor: Cyr A. Ryan, Oldwick, N.J.

[73] Assignee: Fiber Optics Systems, Inc., Whitehouse Station, N.J.

[21] Appl. No.: 83,493

[22] Filed: Jun. 25, 1993

[51] Int. Cl.[6] ..... F21V 8/00

[52] U.S. Cl. ..... 362/32; 362/284; 362/293; 362/806; 40/433; 40/547; 40/559

[58] Field of Search ..... 362/32, 293, 806, 811, 362/812, 282, 284; 40/433, 444, 547, 559, 560, 581

[56] References Cited

U.S. PATENT DOCUMENTS

| | | | |
|---|---|---|---|
| 1,351,562 | 8/1920 | Foster | 362/32 |
| 2,507,909 | 5/1950 | Kaysen | 40/547 |
| 3,184,872 | 5/1965 | Way | 40/433 |
| 3,563,204 | 2/1971 | Szilagyi | 40/406 |
| 3,755,664 | 8/1973 | Reiback | 40/433 |
| 3,803,398 | 4/1974 | Walker | 362/811 |
| 3,836,911 | 9/1974 | Gibson | 40/452 |
| 4,149,902 | 4/1979 | Mauer | 136/247 |
| 4,196,539 | 4/1980 | Speers | 40/547 |
| 4,227,327 | 10/1980 | Thompson | 40/473 |
| 4,262,327 | 4/1981 | Kovacik | 362/223 |
| 4,279,089 | 7/1981 | Murakami | 40/547 |
| 4,374,406 | 2/1983 | Hepp | 362/253 |
| 4,379,324 | 4/1983 | Thompson | 362/253 |
| 4,517,758 | 5/1985 | Thompson | 40/431 |
| 4,596,083 | 6/1986 | Thompson | 40/473 |
| 4,745,525 | 5/1988 | Sheehy | 362/32 |
| 4,780,798 | 10/1988 | Iida | 362/32 |
| 4,807,092 | 2/1989 | Hasegawa | 362/32 |
| 4,847,739 | 7/1989 | Saraceni | 362/232 |
| 4,858,086 | 8/1989 | Pietrantonio et al. | 362/32 |
| 4,860,475 | 8/1989 | Levy et al. | 40/547 |
| 4,917,448 | 4/1990 | Oppenheimer | 385/116 |
| 4,970,815 | 11/1990 | Sunderland | 40/546 |
| 5,020,882 | 6/1991 | Makow | 359/64 |
| 5,067,059 | 11/1991 | Hwang | 362/32 |
| 5,122,890 | 6/1992 | Makow | 359/63 |
| 5,193,901 | 3/1993 | Stone | 362/32 |

*Primary Examiner*—Ira S. Lazarus
*Assistant Examiner*—Alan B. Cariaso
*Attorney, Agent, or Firm*—Leroy G. Sinn

[57] ABSTRACT

Provided by this invention is an improved animated light signage device in which no electrical line connecting to an electrical wall outlet is used and no internal light source is used. The device has an animation element through which light flows and is forwarded through optical fibers to provide an animated light signage in one or more display face panels. A process for providing animated light signage by use of the device is also a part of the invention.

17 Claims, 5 Drawing Sheets

ANIMATED LIGHT SIGNAGE DEVICE AND PROCESS

TECHNICAL FIELD

This invention relates to a device for providing an animated or moving signage determined by a predetermined arrangement coupled with a changing lighting pattern. This invention is directed to such an animated device wherein the necessity of utilizing an electrical line leading from the device to an electrical outlet is avoided, but the device still provides the desired animated signage. Additionally, the invention also is directed to providing animated light signage using the device.

BACKGROUND ART

Animated signage devices are generally known. They have a light element and a moving element which changes the pattern of light to a face panel showing a signage. This change of pattern light flow results in the appearance of animation in the signage.

It would be highly desirable to provide improved animated signage devices which avoid the troublesome and sometimes dangerous necessity for an electrical line to provide the power to the light element and to provide additional desired advantages.

SUMMARY OF INVENTION

An animated light signage device is provided which comprises the following:

1) one or more display face panels having a plurality of optical fiber receiving openings;
2) a light transmission base panel having one or more light receiving openings which are adapted to receive and hold in place optical fibers which transmit light;
3) a series of optical fibers connecting the one or more light receiving openings of the transmission panel with corresponding openings in the one or more display face panels;
4) an animation element movably suspended adjacent to the light receiving side of the transmission base panel opposite to the optical fiber receiving side and in a location which can alter the light flow through the optical fibers to provide the desired animated light signage, said animation element positioned to receive a flow of light adequate to provide the desired animated light signage;
5) a motor for driving said animation element; and
6) a power source to provide electrical energy to power said motor;

said device adapted to receive a flow of light from an existing light source within the room or other environment in which the device is used and external to said device, which light passes through the animation element and the opening or openings of the transmission panel through the series of optical fibers to provide the one or more display face panels the desired animated light signage; and said device being free of the necessity of an electrical line to an electrical outlet.

A display face panel can be affixed directly or indirectly to the light transmission base panel of said device or it can be positioned elsewhere in the room or other environment used in operating the device in order to provide the animated signage at the location desired.

The light source which is external to the device is selected from an existing light source within the room or other environment in which the device is operated. Ordinarily, it can be a conventional light in the room, such as a recessed ceiling light. The device is positioned in the path of the light flowing from the existing external light source. The device can be suitably, if desired, located contiguous to the light source. Further, if desired, it can be attached to the existing and external light source fixture or to the wall adjacent to the light source fixture with suitable fasteners, such as by a pair of chains, ropes, clamps or the like.

The power source for driving the motor can be an appropriate solar panel of suitable size to receive the required light, from an external source, such as from a ceiling light, that also provides a flow of the required light which passes through the transmission base panel to effect the animated light signage on the one or more display panels of the device. Alternately, the power source can be a suitable battery or batteries. If multiple face panels are used in the device, the signage of the face panels can be the same or different.

DETAILED DESCRIPTION OF THE INVENTION AND THE PREFERRED EMBODIMENTS

Figure 1:
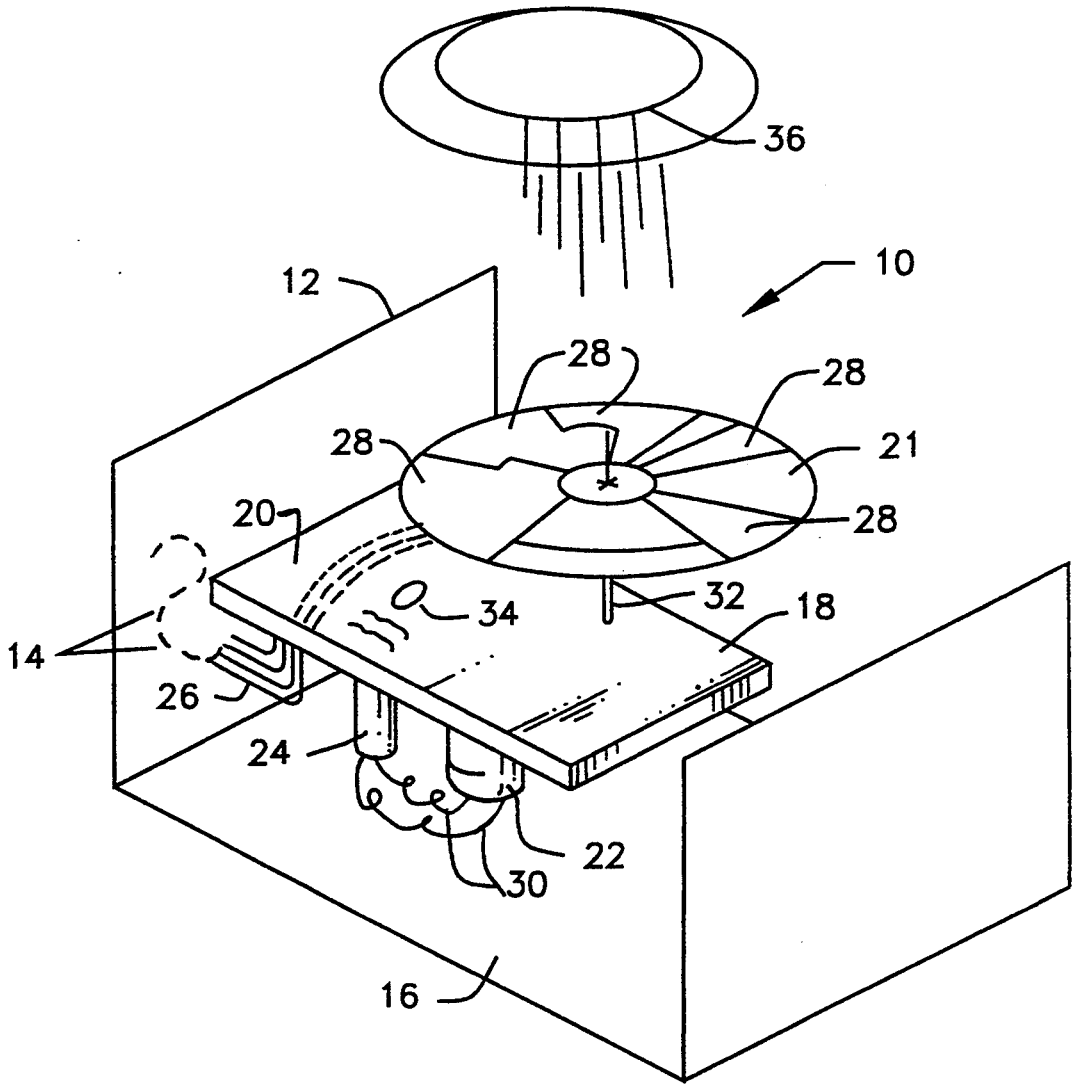
FIG. 1 is a side elevation view of an animated light signage device (10) which has display face panel (12) having a series of openings (14) to receive optical fibers (26) leading from the openings to the transmission base panel (18), which has a matrix of openings (20) corresponding to the openings of the display face panel (12). An animation element (21) is connected by shaft (32) of the motor (22), which is powered by the voltaic cell system (24) by leads (30). An opening (34) is provided in the transmission panel within the periphery of the path of light passing from the exterior light source (36) flowing through the animation element disc (21) to permit light to pass to provide light energy to the voltaic cell.

The animated light signage device of this invention is illustrated by the device shown in FIG. 1. In FIG. 1, a device (10) is shown having a display face panel (12) which is connected to a transmission base panel (18) by way of a series of optical fibers (26). The display face panel has a plurality of receiving openings for the optical fibers connecting an individual opening of the display face panel with a corresponding opening of a matrix of openings (20) (or opening) in the transmission base panel (18). The display face panel can be attached to a base (16) or to the transmission base panel (18) or it can be located in a predetermined fixed position remote from base (16) and connected through the series of optical fibers (26) to the transmission base panel (18). Above the transmission base panel is located the animation element (21), which is supported by and fastened to a shaft (32). The animation element is positioned at a location by which the animation element (21) can be rotated or moved about so as to alter the flow of light and nature of light (such as the color of the light) passing through the optical fibers (26) to provide the desired animated light signage on display face panel (12). The shaft (32) is driven by motor (22).

The motor is connected as shown in FIG. 1 by means of leads (30) to a voltaic panel system (24). The voltaic panel system receives the light energy that is required by the voltaic cell to generate power from a light source located within the room or the environment in which the animated light signage device is used and which is external to the device. The voltaic cell used can be of any suitable size, ordinarily a 100-millivolt voltaic cell is suitable. The size of the voltaic cell can be adjusted as required. The opening (34) is located in the transmission panel but desirably within the periphery of path of light flowing from the exterior light source (36) through the animation element. The animation element can be adjusted in speed of rotation or pattern of rotation speed as desired by adjusting the speed of the motor driving the shaft (32) in accordance with the ordinary skill of the art.

Instead of using a voltaic panel system as shown in the FIG. 1 device, a battery or batteries can be used which are of adequate size to power the motor required to move the animation element. Suitable batteries are ordinarily found to be dry cell batteries such as two 1.5 volt (size D) batteries. Other suitable batteries of larger or smaller size can be used if desired.

The display face panel can be made of any suitable material having the requisite strength and dimensional stability. It must provide adequate surfaces for the openings (14) to receive and to hold in fixed position the respective optical fibers (26). Suitable materials for making this panel are polymethylacrylate, impact polystyrene, cardboard, other suitable polymers, wood and the like.

The optical fibers are selected which will provide good and efficient flow of light from the openings (20) of panel (18) to openings (14) of display face panel (12). Suitable optical fibers are made of polyester, acrylic polymer, polymethylmethacrylate, polystyrene, glass fibers or other suitable materials. The fibers ordinarily have a core of one density and coating or sheath having a greater density. Ordinarily, a suitable size of the fibers in many uses is in the range of 0.25 mm to 3.0 mm diameter. Use of about 0.75 mm 1.5 mm diameter has been found satisfactory.

The transmission panel (18) can likewise be made of the materials mentioned in connection with the construction of display face panel (12).

The motor utilized for driving the animation element can be of any suitable size adequate to drive the animation element. For many uses, a suitable motor is a 3 volt, 6-milliamp DC motor with a stall torque of 18 inches.

The voltaic cell system can be any suitable one that can receive the light and provide sufficient power to drive the motor (22). It has been found that a voltaic cell to provide the solar system for generating the required power can be an encapsulated high impact type. For example, it has been found suitable to use a voltaic cell solar unit which has 6 cells wired for 3 volts at 100 milliamps, and which has a size of 3.75 inches by 2 inches by 0.25 inches. The type and size of the voltaic cell can be varied as desired so long as it is adequate to provide the necessary power.

Instead of the animation element being mounted on and driven by the shaft of the motor, the animation element can be turned or otherwise moved as desired by use of belts, gears, and the like.

The animation disc shown can be made of any material which permits the desired passage of light through the disc into the openings (20) of transmission panel (18). It has been found that polymethylmethacrylate is suitable for this purpose. The animation element as shown has a series of areas (28) which can vary in color to provide a change of color as the animation element rotates as desired, such as red, green, white, blue, etc. Also, the animation disc provides a change in the quantity of light flowing through the disc as that portion of the disc passes over the individual openings (20), including total momentary interruption of light.

The animation element, instead of being positioned in a rotatable location above the transmission panel, can be moved above the openings matrix (20) of the transmission panel (18) in a different manner. For example, it can be moved over the openings matrix (20) in a linear direction or some other oscillating direction to interrupt or to modify the light flow through individual optical fibers (26) as desired to provide the predetermined animated light signage.

As mentioned previously, the device (10) can be located in the room or environment in which the device is being used in a set position to receive the light flow from the exterior source. It can be placed on a table or on a stand so long as there is adequate flow of light from the exterior source (36). The device can be suspended below a recessed ceiling light, for example, as by suspending using a pair of chains, clamps, ropes, fasteners, or the like.

It is to be noted that a great advantage of this device is to avoid any need to provide power for a light source in the device itself, requiring either an electrical line to connect with a wall electrical outlet or to provide power through a battery. A battery adequate to provide the required light is expensive and must be recharged or replaced at frequent intervals. Another problem with such use of an adequate battery is prohibitive weight. By the use of the device of this invention, a battery entailing such costs and disadvantages is avoided.

FIGS. 2, 3, 4 and 5 are described above.

Figure 2:
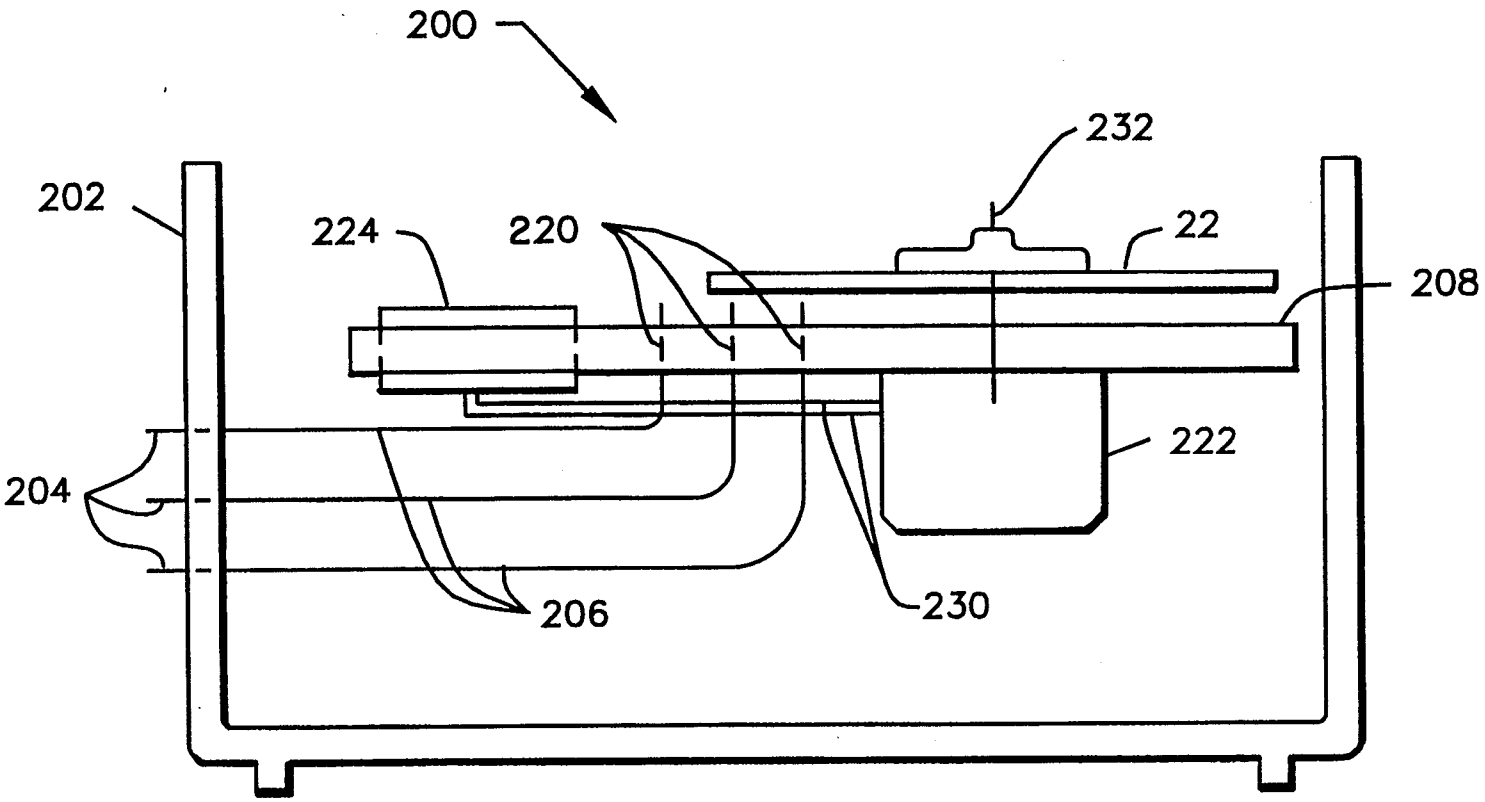
FIG. 2 is a partial cross sectional side view of a signage device (200) of the invention which has a display face panel (202), having a series of openings (204) to receive optical fibers (206) leading from the openings to the transmission base panel (208) which has a matrix of openings (220) corresponding to the openings of the face panel (202), an animation element (221) is connected to the shaft (232) of the motor (222) which is provided energy by the voltaic cell system (224) by leads (230).

FIG. 2 is a partial cross sectional side view of a device of the invention which has a voltaic cell system as power source.

Figure 3:
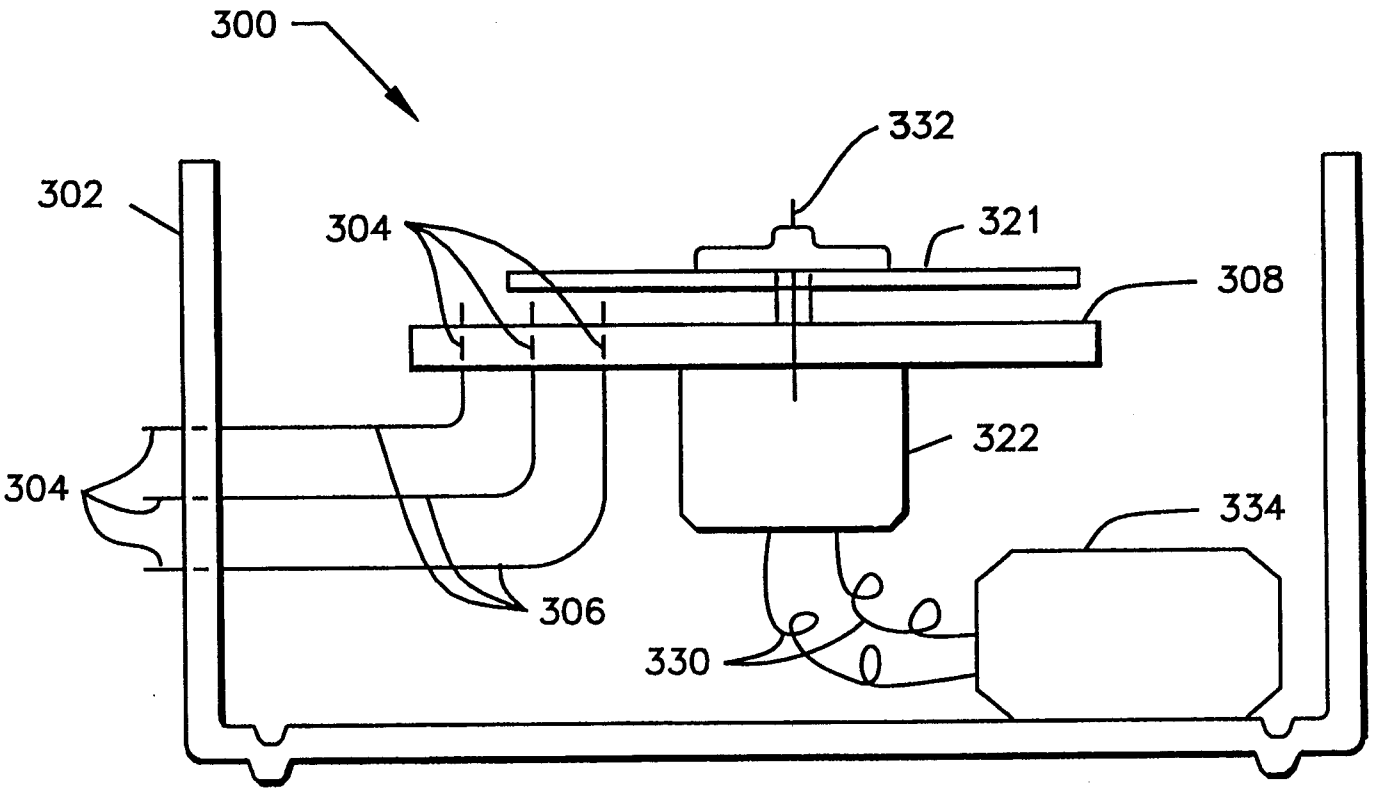
FIG. 3 is a partial cross sectional side view of a signage device (300) of the invention which has a display face panel (302) having a series of openings (304) to receive optical fibers (306) leading from the openings to the transmission base panel (308), which has a matrix of optical fiber receiving openings (306) corresponding to the openings of the display panel (302), an animation element (321) is connected to the shaft (332) of the motor (222), which is powered by battery (334) connected to the motor by leads (330).

FIG. 3 is a partial cross sectional side view of a device of the invention which has a battery power source.

Figure 4:
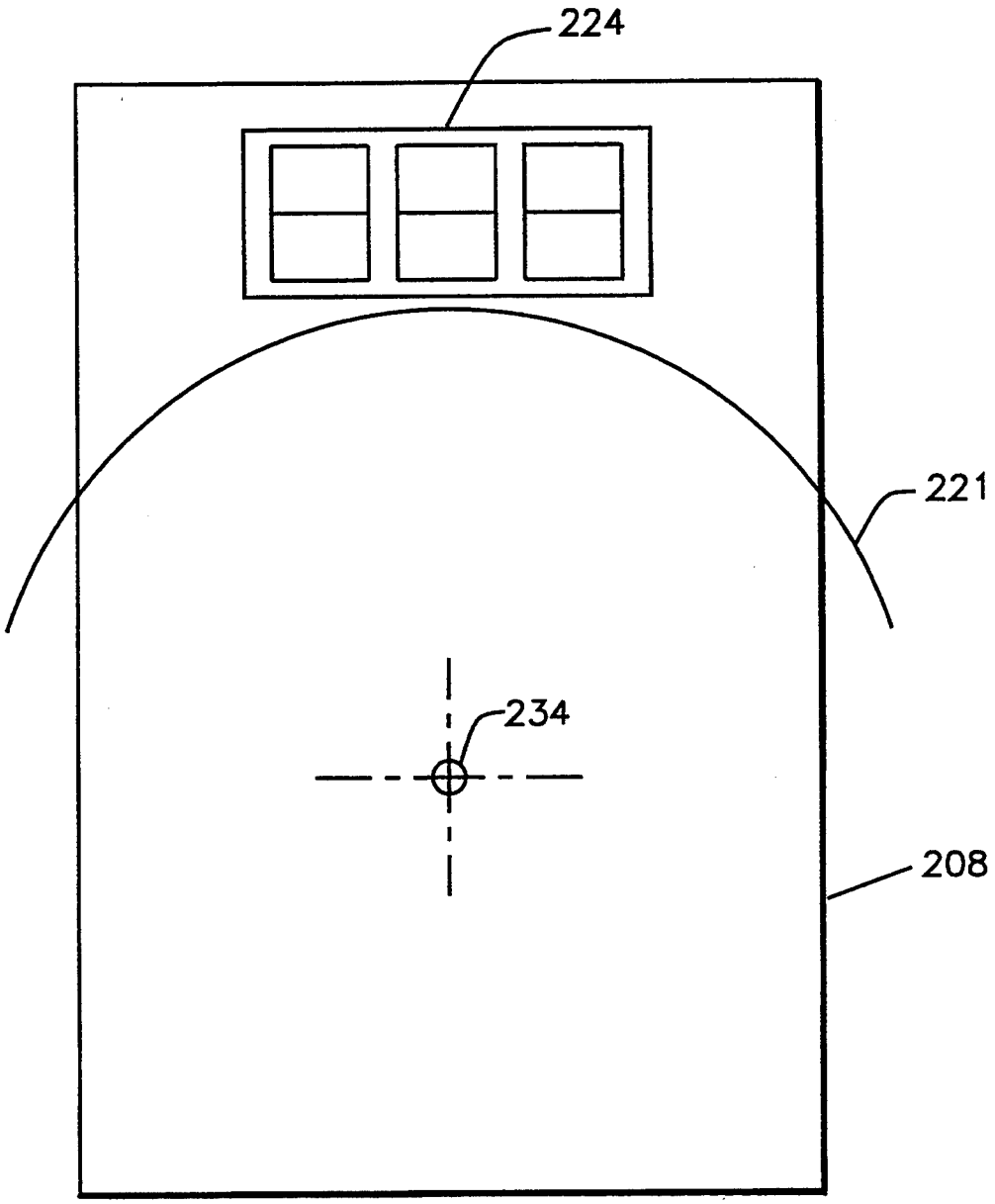
FIG. 4 is a top plan view of the transmission base panel (208) and the voltaic cell system as shown in FIG. 3 with only the adjacent partial outline of the animation element (221) shown. Opening for the motor shaft (234) is also shown.

FIG. 4 is a top plan view of a transmission base panel having affixed at the end thereof a voltaic cell system as power source.

Figure 5:
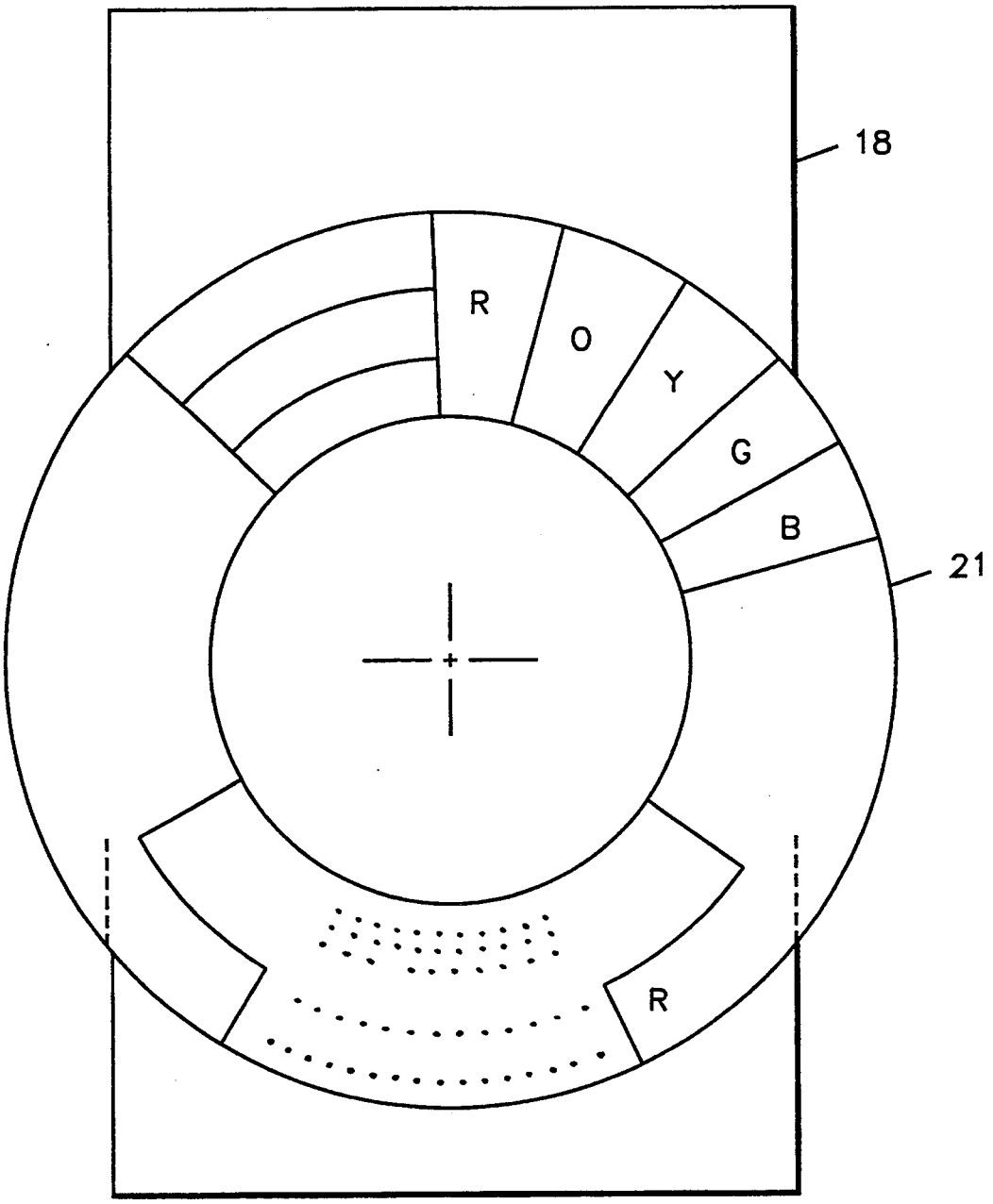
FIG. 5 is a top plan view of the animation element (21) of FIG. 1 showing the transmission base panel (18) positioned below the animation disc. Letter designations are shown: R—red; O—orange; Y—yellow; G—green; B—blue.

FIG. 5 is a top plan view of an animation element of a device of this invention.

It will be evident to those having ordinary skill in the art that certain modifications can be made to the animated light signage device of this invention and such modifications are, insofar as they encompass the spirit of this invention, included within the intended scope of the appended claims.

What is claimed is:

1. An animated light signage device having no integral light source comprising:

1) one or more display face panels having a plurality of optical fiber receiving openings;

2) a light transmission panel having a light receiving side with one or more light receiving openings, said openings adapted to receive and hold in place the optical fibers;

3) a series of optical fibers integrally connected to said opening or openings of the transmission panel with the openings in the display face panel;

4) an animation element movably positioned adjacent to the light receiving side of the transmission panel in a location to effect altering the flow of light through the optical fibers to provide the desired animated light signage;

5) a motor for driving said animation element;

6) a power source to provide electrical energy to power said motor; and 7) absence of light source integral with said device; said device adapted to receive an adequate flow of light from a light source external and non-integral with said device, said light passing through the animation element and the opening or openings of the transmission panel through the series of optical fibers to provide the desired animated light signage on the one or more display face panels; and said device being free of an electrical line connecting to an electrical outlet.

2. A device according to claim 1 wherein the power source is a voltaic cell system.

3. A device according to claim 1 wherein the power source is a battery.

4. A device according to claim 1 wherein the animation element is a rotating disc.

5. A device according to claim 4 wherein the power source is a voltaic cell system.

6. A device according to claim 4 wherein the power source is a battery.

7. A process for providing an animated light signage by

A. placing a light signage device in a location desired to have an animated light signage, said device comprising:

1) one or more display face panels having a plurality of optical fiber receiving openings;

2) a light transmission panel having a light receiving side with one or more light receiving openings, said openings adapted to receive and hold in place the optical fibers;

3) a series of optical fibers integrally connected to said opening or openings of the transmission panel with the openings in the display face panel;

4) an animation element movably positioned adjacent to the light receiving side of the transmission panel in a location to effect altering the flow of light through the optical fibers to provide the desired animated light signage;

5) a motor for driving said animation element;

6) a power source to provide electrical energy to power said motor; and 7) absence of light source integral with said device; said device adapted to receive an adequate flow of light from a light source external and non-integral with said device, said light passing through the animation element and the opening or openings of the transmission panel thruough the series of optical fibers to provide the desired animated light signage on the one or more display face panels; and said device being free of an electrical line connecting to an electrical outlet;

B. positioning said device in path of said external and non-integral light source for said device; and C. activating said motor for driving said animation element.

8. A process of claim 7 wherein the power source is a voltaic cell system.

9. A process of claim 7 wherein the power source is a battery.

10. A process of claim 7 wherein the animation element is a rotating disc.

11. A process of claim 10 wherein the power source is a voltaic cell system.

12. A process of claim 10 wherein the power source is a battery.

13. A process according to claim 7 wherein the power source of the device employed is a voltaic cell system.

14. A process according to claim 7 wherein the power source of the device employed is a battery.

15. A process according to claim 7 wherein the animation element of the device employed is a rotating disc.

16. An animated light signage device having no integral light source comprising:

1) one or more display face panels having a plurality of optical fiber receiving openings;

2) a light transmission panel horizontally disposed having a light receiving side with one or more light receiving openings, said openings adapted to receive and hold in place the optical fibers;

3) a series of optical fibers integrally connected to said opening or openings of the transmission panel with the openings in the display face panel;

4) an animation element consisting of a horizontally disposed rotating disc rotatably positioned above the light receiving side of the transmission panel in a location to effect altering the flow of light through the optical fibers to provide the desired animated light signage;

5) a motor for driving said animation element;

6) a power source to provide electrical energy to power said motor; and 7) absence of light source integral with said device; said device adapted to receive an adequate flow of light from a light source external and non-integral with said device and vertically disposed above said animation element, said light passing through the animation element and the opening or openings of the transmission panel through the series of optical fibers to provide the desired animated light signage on the one or more display face panels; and said device being free of an electrical line connecting to an electrical outlet.

17. A device according to claim 16 wherein the power source is a voltaic cell system.

* * * * *